United States Patent [19]

Price

[11] Patent Number: 4,745,975

[45] Date of Patent: May 24, 1988

[54] WATER WELL COMPLETION APPARATUS AND METHOD OF USE

[75] Inventor: Delbert Price, Ben Wheeler, Tex.

[73] Assignee: Larry Ray Price, Ben Wheeler, Tex.

[21] Appl. No.: 29,191

[22] Filed: Mar. 23, 1987

[51] Int. Cl.[4] ..... E21B 43/04; E21B 47/04

[52] U.S. Cl. ..... 166/250; 166/51; 166/205; 166/278

[58] Field of Search ..... 166/278, 381, 386, 387, 166/51, 205, 332, 334, 242, 250

[56] References Cited

U.S. PATENT DOCUMENTS

| | | | |
|---|---|---|---|
| 2,978,027 | 4/1961 | Widmyer | 166/51 |
| 3,072,204 | 1/1963 | Brown | 166/51 |
| 3,913,675 | 10/1975 | Smyrl | 166/51 |
| 3,960,366 | 6/1976 | Abney et al. | 166/51 |
| 3,963,076 | 6/1976 | Winslow | 166/334 |
| 4,028,009 | 6/1977 | Gudzenko et al. | 166/51 |
| 4,044,832 | 8/1977 | Richard et al. | 166/278 |
| 4,424,864 | 1/1984 | Logan | 166/51 |

*Primary Examiner*—Stephen J. Novosad
*Assistant Examiner*—Bruce M. Kisliuk
*Attorney, Agent, or Firm*—Ronald B. Sefrna

[57] ABSTRACT

The present invention provides an apparatus and method of completing a water well and preparing the well for placement of a pump for production of water, including the steps of setting a well screen, setting a packing seal, packing the annular space between the well screen and the well bore, and air jet cleaning of contaminated water from the well bore, in a single run down the well bore. The apparatus includes a well seal and screen retainer portion to be left in the well bore, a sand distributor portion, and an air jet portion, all coaxially aligned and releaseably interconnected.

16 Claims, 8 Drawing Sheets

WATER WELL COMPLETION APPARATUS AND METHOD OF USE

FIELD OF THE INVENTION

This inention relates to apparatus and methods for completion of water wells and, more specifically, to an apparatus and method to facilitate the packing of wells with sand or gravel and the air jet cleaning of contaminated water from wells.

BACKGROUND OF THE INVENTION

As part of the completion operations for a water well it is normal practice to place a cylindrical screen or perforated pipe in the well bore through the water bearing strata. In order to prevent clogging of the screen or perforations by fine dirt and sand particles it is desireable to pack the annular space between the cylindrical screen and the well bore with coarse sand or gravel which will act as a barrier or filter against influx of the fine particles and other solid contaminants in the water bearing strata.

It is also desireable, after placement and packing of the screen, to place a well seal or packing seal in the well bore to retain the packing material. The sealing operation is commonly followed by a cleaning operation to remove dirty, contaminated water from the well bore prior to placing a production pump in the well, in order to prevent initial damage to the pump from abrasive materials. The cleaning operation typically consists of introducing an open-ended pipe into the well and introducing compressed air into the well bore through the pipe to force the water from the well through the annular space between the well casing and the pipe.

Each of these operations has, in the past, required a separate run of a string of pipe down the well bore, a time consuming and laborious operation. The present invention overcomes this disadvantage by allowing screen placement, packing, sealing, and cleaning to be performed with a single run down the bore. The present invention also improves the efficiency of the packing and air jet cleaning operations.

SUMMARY OF THE INVENTION

The present invention provides an apparatus for completion of water wells, generally comprising a well seal and screen retainer portion, an intermediate sand distributor portion, and, preferably, an air jet portion, all coaxially aligned and releasably interconnected. In an alternative embodiment of the invention the air jet portion of the apparatus, and the associated air jet cleaning of the well bore, may be omitted for applications in which such air jet cleaning is deemed an unnecessary well completion step. The well seal and screen retainer portion of the apparatus includes an elongate hollow cylindrical housing open at both ends, with an open-ended hollow cylindrical coupler ring of larger diameter than said housing concentrically disposed over one end thereof and interconnected thereto. A conventional annular well seal is concentrically disposed around the outer surface of siad coupler ring and is firmly interconnected thereto. A hollow cylindrical sleeve open at both ends is slideably disposed in the interior of said housing in a closely fitting concentric relationship. The housing is penetrated by a plurality of apertures near the end of said housing to which said coupler ring is interconnected, with such apertures disposed inward of said coupler ring. The well seal and screen retainer portion of the apparatus further includes a coil spring of essentially the same diameter as said sleeve disposed in the interior of said housing between said sleeve and the end of said housing opposite the coupler ring, contained by a spring retainer means, such as an O-ring disposed in a groove in the inner surface of said housing. The coil spring should be of sufficient length to bias said sleeve toward a rest position within said housing where said sleeve obstructs the apertures penetrating said housing. Retainer means are provided to retain said sleeve in its rest position.

The sand distributor portion of the apparatus includes an open-ended hollow cylindrical housing with a hollow cylindrical insert, of greater length than said housing, having one end disposed in the interior of said housing and interconnected thereto at that end such that an annular space is provided between the inner surface of said housing and the outer surface of said insert, and with the other end of said insert extending beyond the end of said housing. The sand distributor portion further includes an open-ended hollow cylindrical collar coaxially aligned with said housing and insert and slideably disposed about said insert so as to allow said collar to slide along said insert and into the annular space between said insert and said housing. Said collar is biased toward a rest position at the end of said insert opposite its interconnection with said housing by a coil spring which is disposed in the annular space between said insert and said housing and interconnected to said collar. Retainer means are provided to retain said collar in its rest position. The end of said insert extending beyond the end of said housing is closed, includes a preferably conical sand distributor coaxially aligned with the longitudinal axis of said insert, and the wall of said insert is penetrated by a plurality of apertures near its closed end.

The air jet portion of the apparatus includes an elongate hollow open-ended cylindrical housing, penetrated by a plurality of apertures intermediate its two ends. The air jet portion further includes a hollow cylindrical air distributor, of larger cross-sectional diameter than said housing, concentrically disposed around the outer surface of the wall of said housing to overlay said apertures, and interconnected to the outer surface of the wall of said housing by a closure ring or plate.

The three major portions of the apparatus are designed to be releaseably interconnected in coaxial alignment, preferably by threaded screw fittings. As the sand distributor portion of the apparatus is brought into interconnection with the well seal and screen retainer portion, the insert of the sand distributor portion abuts the sleeve of the well seal and screen retainer portion and forces the sleeve to slide toward the opposite end of the apparatus against its associated coil spring. At the same time, the collar of the sand distributor portion of the apparatus abuts the housing of the well seal and screen retainer portion and is forced to slide along the insert of the sand distributor portion into the annular space between said insert and housing, against its associated coil spring. The sliding movement of said sleeve and of said collar uncovers the respective apertures obstructed by such components while in their rest positions, and such apertures are brought into coaxial alignment upon completion of the interconnection of these two portions of the apparatus. With alignment of said apertures a flow path for packing sand or gravel is established through the hollow interior of the apparatus to the well bore on the exterior of the apparatus, below the well seal component, by passage through such aligned apertures. At this stage of interconnection the apparatus may be interconnected to a string of hollow drill pipe and used to set the well screen, set the well seal, and sand or gravel pack the well in a single step, if air jet cleaning of the well bore above the well seal is not desired. However, if such cleaning is desired, the air jet portion of the apparatus is brought into interconnection with the end of the sand distributor portion opposite its interconnection with the well seal and screen retainer portion, preferably by threading the two portions together. The thread direction for the interconnection between the well seal and screen retainer portion and the sand distributor portion of the apparatus should be opposite the thread direction for interconnection of the sand distributor portion to the air jet portion as well as opposite the thread direction for interconnection of the apparatus to the string of drill pipe and within such string itself. Such a thread arrangement allows the well seal and screen retainer portion to be disconnected and left in the well bore without loosening the remaining interconnections.

The interconnected apparatus is fitted with a suitable conventional screen at its lower end, is attached to a string of hollow drill pipe at its upper end, and is lowered into the well bore to the desired location. Packing sand or gravel is then introduced into the top of the drill string, falls through the interior of the drill pipe and through the interior of the apparatus to exit into the annular space between the well bore sides and the portion of the apparatus and screen below the well seal, through the aligned apertures lying below such seal. When the packing is completed the drill string and the upper portions of the apparatus are rotated to release the interconnection between the well seal and screen retainer portion and the sand distributor portion of the apparatus. The well seal and screen retainer portion of the apparatus is abandoned in the well bore to maintain the well seal above the packed annular space and to provide a water flow path upward through the hollow interior of that portion of the apparatus.

As the interconnection between the well seal and screen retainer portion and the sand distributor portion of the apparatus is released, the sleeve and collar are forced to return to their respective rest positions by their associated coil springs, and again obstruct the respective apertures to close the sand or gravel flow path. Pressurized air is then introduced into the interior of the drill string. With the apertures in the sand distributor portion of the apparatus obstructed by the collar associated with that portion, the air passes through the apertures penetrating the wall of the housing of the air jet portion to the annular space between such housing and the air distributor. The air flow is directed upward in the annular space between the well bore and the interconnected apparatus and drill string, forcing water contained in such annular space upward and out the top of the well bore, carrying dirt and other contaminants with it.

These and other features and advantages of the present invention will become more apparent from the following detailed description, with reference to the accompanying drawing figures.

DETAILED DESCRIPTION OF THE INVENTION

Figure 2:
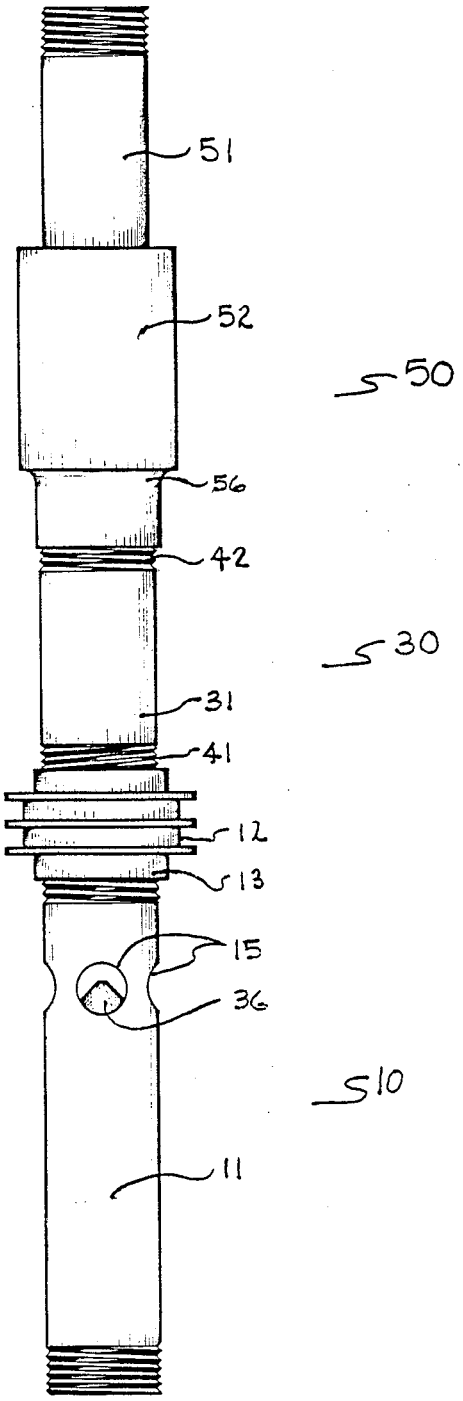
FIG. 2 is an elevation view of the interconnected portions of the apparatus of the present invention.
Figure 3:
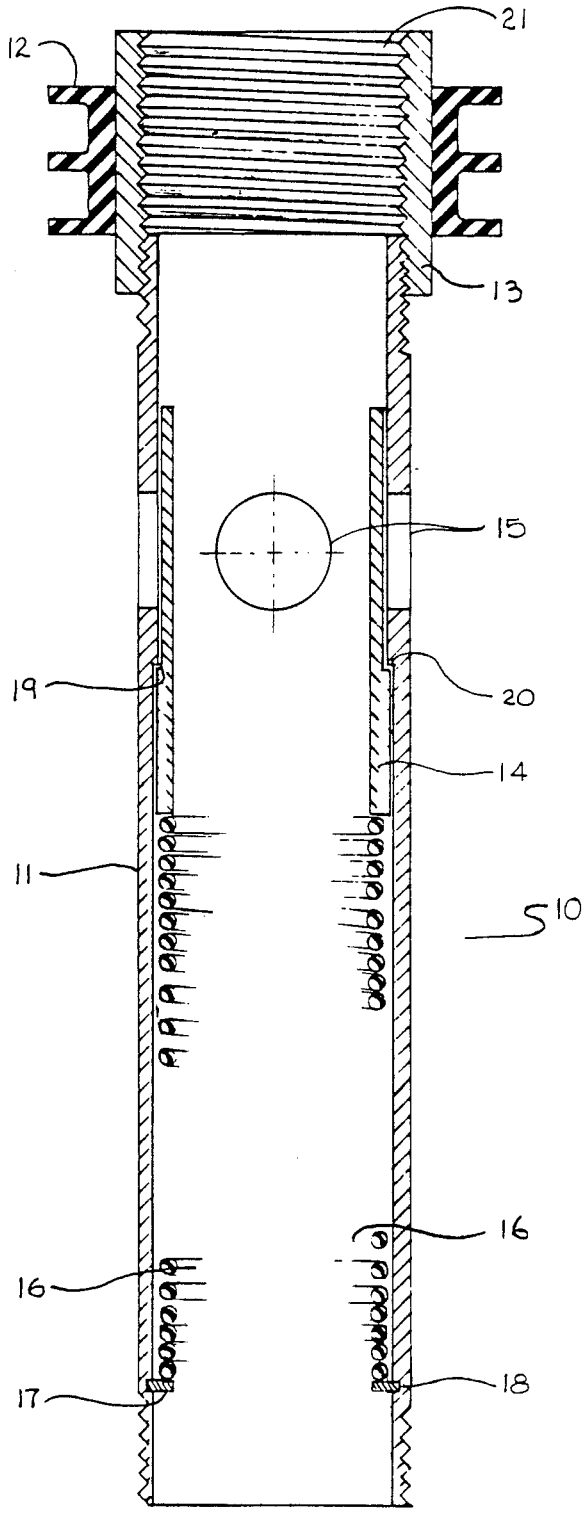
FIG. 3 is a longitudinally cross-sectioned elevation view of the well seal and screen retainer portion of the apparatus of the invention.

With reference to FIG. 2, it will be seen that the preferred embodiment of the apparatus of the present invention generally comprises a well seal and screen retainer portion 10, a sand distributor portion 30, and an air jet portion 50, coaxially aligned and releaseably interconnected. As depicted in FIG. 3, well seal and screen retainer portion 10 includes elongate hollow cylindrical housing 11, conventional well seal 12, coupler ring 13, and hollow cylindrical sleeve 14. Well seal 12 is coaxially aligned with coupler ring 13 and is interconnected to the outer surface of said coupler ring intermediate its two ends. Coupler ring 13 comprises an open-ended hollow cylinder with a continuous annular side wall having an inside cross-sectional diameter generally equal to the outside cross-sectional diameter of housing 11. One end of housing 11 is inserted into the interior of coupler ring 13 through approximately half the length of coupler ring 13, and interconnected thereto. Such interconnection is preferably made by mating right-hand screw threads on the outer surface of housing 11 and the inner surface of coupler ring 13, but any convenient interconnecting means, such as welding, may be employed. Housing 11 is penetrated by a plurality of apertures 15 disposed near the interconnection between housing 11 and coupler ring 13, such apertures having their longitudinal axes contained withing a single plane perpendicular to the longitudinal axis of housing 11. Sleeve 14 is slideably disposed in the interior of housing 11 and is, in the preferred embodiment of the invention, biased toward a rest position within the interior of housing 11 by coil spring 16. Coil spring 16 is disposed in the interior of housing 11 between sleeve 14 and the end of housing 11 opposite its interconnection to coupling ring 13, and is retained in place by a spring retainer means, preferably retainer ring 17 disposed in groove 18. In its rest position sleeve 14 obstructs apertures 15 to prevent passage of water and other materials therethrough, and is retained in such rest position against the force of coil spring 16 by abutment of shoulders 19 and 20 on the outer surface of sleeve 14 and the inner surface of housing 11, respectively.

Figure 4:
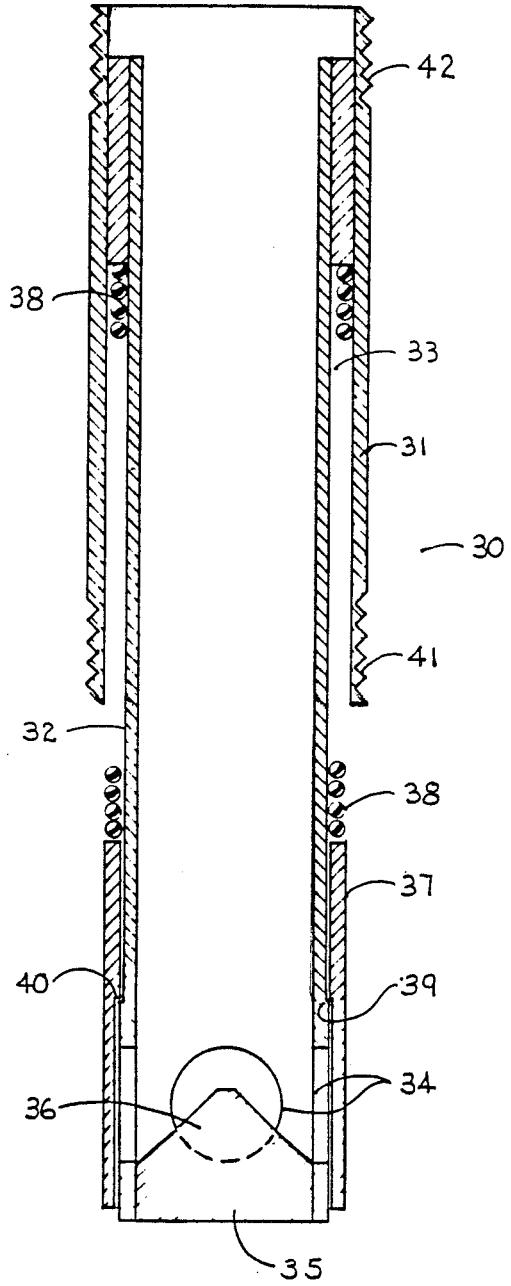
FIG. 4 is a longitudinally cross-sectioned elevation view of the sand distributor portion of the apparatus of the invention.

With reference to FIG. 4, sand distributor portion 30 of the apparatus will be seen to include open-ended hollow cylindrical housing 31 with an outside cross-sectional diameter substantially equal to the outside cross-sectional diameter of housing 11. Sand distributor portion 30 further includes elongate hollow cylindrical insert 32 with an outside cross-sectional diameter slightly smaller than the inside cross-sectional diameter of the portion of housing 11 between shoulder 20 and the interconnection between housing 11 and coupling ring 13, so that insert 32 may be partially inserted into the interior of housing 11. Insert 32 is of substantially greater length than housing 31, is inserted through the interior of housing 31 in concentric coaxial alignment such that a first end of insert 32 is generally aligned with a first end of housing 31, and is rigidly interconnected to housing 31 at such first ends. The relation between housing 31 and insert 32 is such that the second end of insert 32 extends beyond the second end of housing 31, and annular space 33 is provided between the inner surface of housing 31 and the outer surface of the part of insert 32 disposed in the interior of said housing. Insert 32 is penetrated near its second end by a plurality of apertures 34, having their axes contained within a single plane perpendicular to the longitudinal axis of insert 32. Insert 32 is open at its first end and is closed at its second end by closure plate 35, which includes sand distributor 36 on its inner surface. Sand distributor 36 is preferably of conical configuration with a base diameter generally equal to the inside diameter of insert 32, disposed in the interior of insert 32 with the plane of its base tangent to the edges of apertures 34 nearest the second end of insert 32.

Sand distributor portion 30 of the apparatus additionally includes open-ended hollow cylindrical collar 37, having a major inside cross-sectional diameter slightly larger than the major ouside cross-sectional diameter of insert 32, and an outside cross-sectional diameter slightly smaller than the inside cross-sectional diameter of housing 31. Collar 37 is slideably disposed around insert 32 in concentric coaxial alignment with said insert and with housing 31, and is retained in a rest position obstructing apertures 34 by means of coil spring 38. Coil spring 38 is disposed around insert 32 between collar 37 and the interconnection between insert 32 and housing 31 and is contained largely within annular space 33. Collar 37 is retained in its rest position against the force of coil spring 38 by abutment of shoulders 39 and 40, formed on the inner surface of collar 37 and the outer surface of insert 32, respectively. Sand distributor portion 30 is designed to be interconnected to well seal and screen retainer portion 10 by means of left-hand screw threads 41 and 21, formed on the outer surface of the second end of housing 31 and the inner surface of coupler ring 13, respectively.

Figure 5:
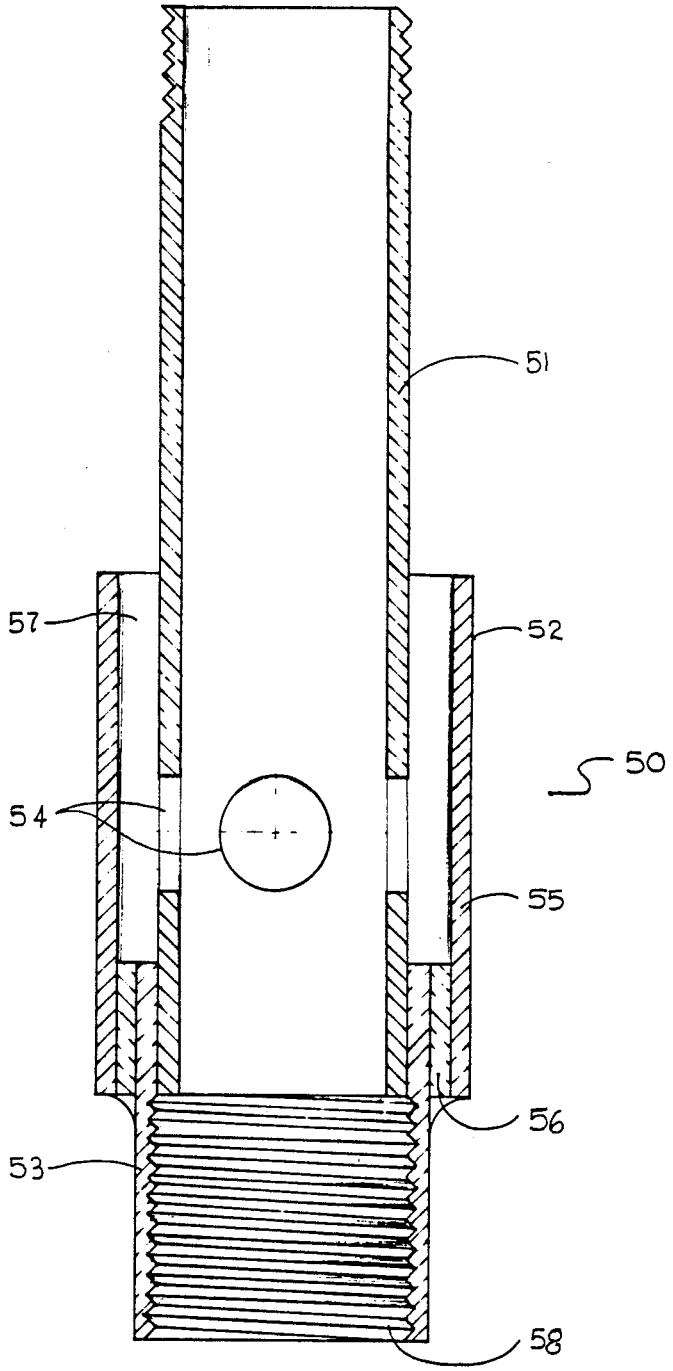
FIG. 5 is a longitudinally cross-sectioned elevation view of the air jet portion of the apparatus of the invention.

The air jet portion 50 of the apparatus of the present invention, depicted in FIG. 5, generally comprises cylindrical housing 51, air distributor 52, and coupler ring 53. Housing 51 comprises an elongate open-ended hollow cylinder of essentially the same cross-sectional diameter as housing 11 and housing 31. A first end of housing 51 includes right-hand screw threads formed on its outer surface to allow its connection to a string of drill pipe, and housing 51 is penetrated, near its second end by a plurality of apertures 54 with their axes contained in a single plane perpendicular to the longitudinal axis of housing 51. Air distributor 52 comprises a hollow cylindrical body with continuous side wall 55, disposed around housing 51 in coaxial alignment and interconnected thereto by means of annular closure plate 56 aligned with the second end of housing 51. Air distributor 52 is longitudinally disposed on housing 51 such that side wall 55 overlies apertures 54, and is of sufficiently larger cross-sectional diameter than housing 51 to provide annular space 57 between the outer surface of housing 51 and the inner surface of side wall 55. The outside cross-sectional diameter of air distributor 52 is selected to be slightly less than the inside cross-sectional diameter of the casing in the well bore to be completed with the apparatus of the invention. Coupler ring 53 comprises an open-ended hollow cylinder with an inside cross-sectional diameter slightly smaller than the outside cross-sectional diameter of housing 31, and is rigidly interconnected to closure plate 56 in coaxial alignment with housing 51 and air distributor 52. Air jet portion 50 is designed to be interconnected to sand distributor portion 30 of the apparatus by means of right-hand screw threads 58 and 42, formed on the inner surface of coupler ring 53 and the outer surface of the first end of housing 31, respectively.

Figure 8:
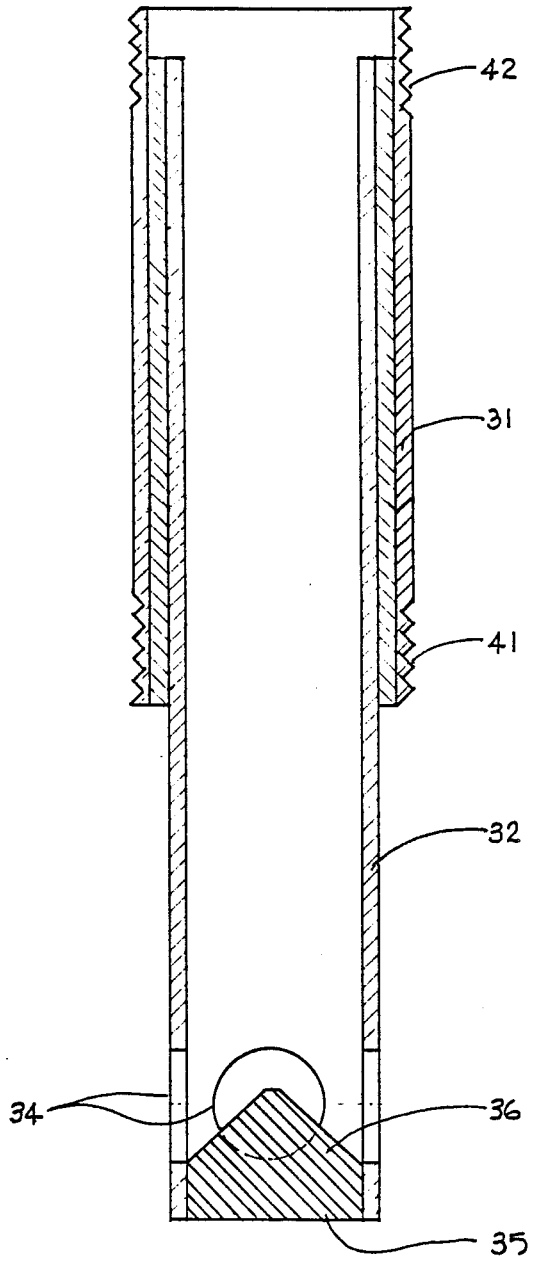
FIG. 8 is a longitudinally cross-sectioned elevation view of a simplified alternative embodiment of the apparatus of the invention, designed for water well completion operations in which air jet cleaning of the well bore is not desired.

In a simplified alternative embodiment of the apparatus of the invention, for use in water well completion operations in which air jet cleaning of the well bore is not desired, air jet portion 50 of the apparatus is entirely omitted. In addition, sand distributor portion 30 is simplified by omission of collar 37, coil spring 38 and shoulder 40, as illustrated in FIG. 8. With omission of shoulder 40, insert 32 is of the same outside cross-sectional diameter, being the diameter of its second end in the preferred embodiment, throughout its length.

Figure 6:
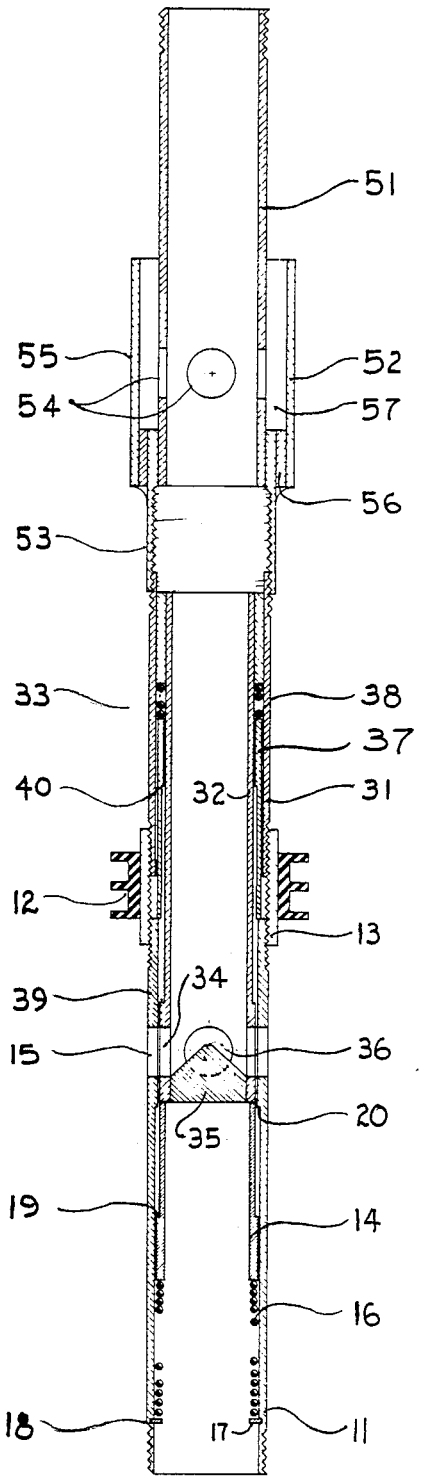
FIG. 6 is a longitudinally cross-sectioned elevation view of the three portions of the apparatus of the invention in interconnected relationship, without well screen or drill pipe string.
Figure 7:
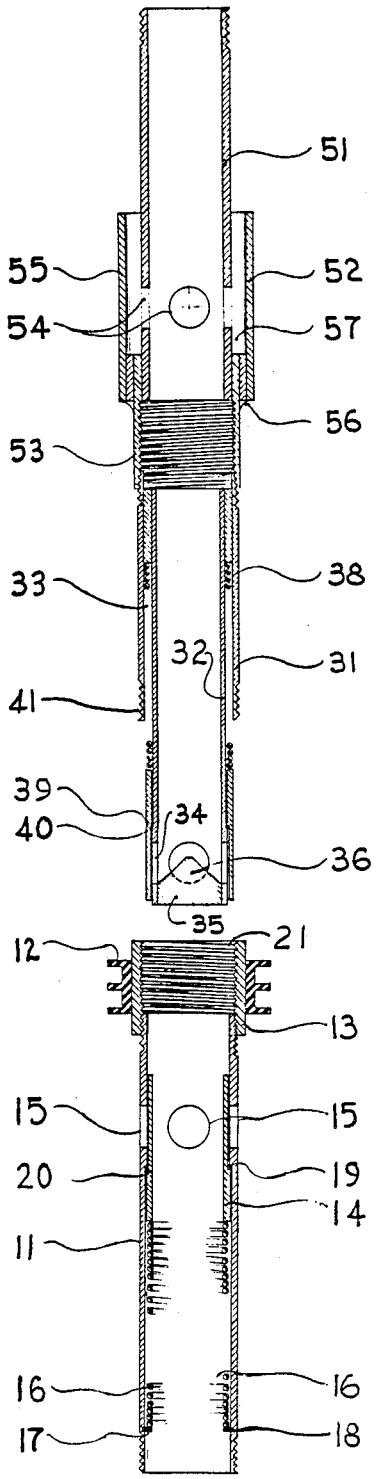
FIG. 7 is a longitudinally cross-sectioned elevation view of the apparatus of the invention showing the well seal and screen retainer portion of the apparatus disconnected from the interconnected sand distributor portion and air jet portion of the apparatus.

In preparation of the preferred embodiment of the apparatus for use in completion of a water well, portions 10, 30, and 50 are coaxially aligned and releaseably interconnected, preferably by means of mating screw threads as disclosed above. As well seal and screen retainer portion 10 and sand distributor portion 30 are brought toward interconnection by insertion of the second end of portion 30 into portion 10 through coupler ring 13, collar 37 abuts housing 11 and the closed end of insert 32 abuts sleeve 14 before coupler ring 13 contacts housing 31 and threads 21 and 41 are engaged. As portions 10 and 30 are brought into interconnection, sleeve 14 is forced to slide along the interior of housing 11 against spring 16, and collar 37 is simultaneously forced to slide along the exterior of insert 32 against spring 38. The components of the apparatus are proportioned such that upon full interconnection of portions 10 and 30 by engagement of threads 21 and 41, sleeve 14 has moved a sufficient distance along housing 11 and collar 37 has moved a sufficient distance along insert 32 to expose apertures 15 and 34, respectively, and said apertures are brought into coaxial alignment. Portion 50 of the apparatus is coaxially aligned with interconnected portions 10 and 30 and brought into interconnection therewith by engagement of threads 58 with threads 42. The fully interconnected apparatus is depicted in FIG. 6 of the accompanying drawings. A conventional well screen may now be interconnected by any convenient means to the end of portion 10 opposite its interconnection to portion 30, and the fully interconnected apparatus, with well screen, may be releasably interconnected to a string of hollow drill pipe for insertion into a well bore.

The common procedure for drilling a water well and preparing it for completion operations includes the steps of drilling a well bore to a depth at which a suitable water bearing strata is encountered. The drill string is then withdrawn and a well casing is inserted into the well bore until its lower end is approximately aligned with the upper boundary of the water bearing strata, and the casing is secured in place. The drill string is reinserted into the well bore and the bore is deepened by drilling through the water bearing strata a distance approximately equal to the length of the well screen to be employed, and the drill string is again removed from the well bore.

Figure 1:
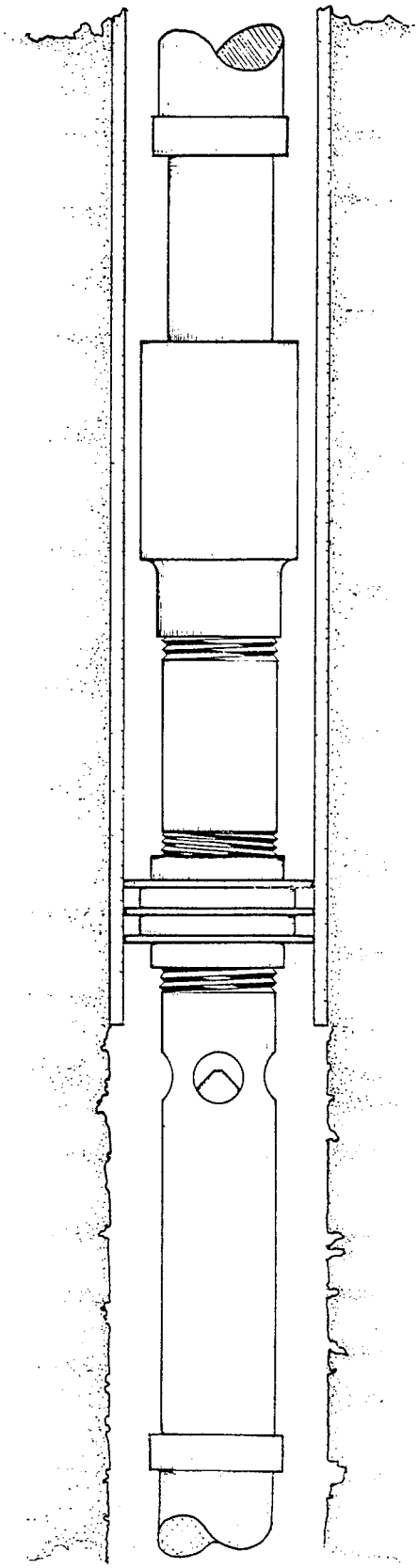
FIG. 1 is an elevation view of the interconnected apparatus, with a conventional well screen, attached to a string of drill pipe and disposed in a partially cased water well bore, illustrating the gravel exit path and the pressurized air exit path.

The apparatus of the invention with a suitable well screen, prepared in the manner disclosed above, is lowered into the well bore until the screen is properly positioned near the bottom of the bore and well seal 12 is positioned within the casing near its lower end, as illustrated in FIG. 1. As indicated by FIG. 1, well seal 12 forms a tight friction seal against the inner casing surface and the outer surface of wall 55 of air distributor 52 is in close proximity to said inner casing surface. Packing sand is then introduced into the top of the string of hollow drill pipe, falls through such pipe and through the interior of portions 50 and 30, respectively, of the apparatus to sand distributor 36, whereupon the packing sand is diverted through aligned apertures 34 and 15 to the exterior of the apparatus below well seal 12. When sufficient packing sand has been introduced through the drill pipe and the apparatus to fill the annular space between the well bore and the exterior of the well screen below well seal 12, introduction of packing sand is ceased.

The string of drill pipe is then rotated in a clockwise direction, tending to tighten all threaded interconnections except the left-handed thread interconnection between portions 10 and 30 of the apparatus, which will be loosened by clockwise rotation. The tight fit of well seal 12 against the well casing and the presence of packing sand around the well screen prevents rotation of portion 10 of the apparatus, so that continued rotation of the string of drill pipe results in disconnection of portion 10 from the remainder of the apparatus without disturbing the interconnection of portions 30 and 50 or the interconnection of those portions to the string of drill pipe. The drill pipe is then raised in the well bore, separating portion 30 of the apparatus from portion 10 and its interconnected well screen, which remain in the well bore. As portions 30 and 10 are separated, sleeve 14 and collar 37 are forced to return to their rest positions by springs 16 and 38, respectively, closing apertures 15 and 34. The closing of apertures 15 prevents water from entering the interior of housing 11 except by passing through the packing sand and screen where removal of fine soil particles and other solid matter is accomplished, and the closing of apertures 34 prevents any undistributed packing sand from entering the well bore above well seal 12.

When the string of drill pipe and remaining portions of the completion apparatus have been raised a sufficient distance to fully separate portions 10 and 30, pressurized air is introduced into the top of the string of drill pipe. The air flows down the interior of the hollow drill pipe and into the interior of the attached completion apparatus. With closure of apertures 34 the only exit path for the pressurized air is through apertures 54 in portion 50 of the apparatus, to annular space 57, where the air is directed into an upward flow pattern. Air is introduced into the drill pipe in sufficient volume and with sufficient pressure to force water in the well bore above well seal 12 upward through the annular space between the well casing and the outer surface of the string of drill pipe out the top of the well bore. Dirt and other contaminants present in the well bore as a result of drilling operations are entrained in the water and removed from the well, substantially reducing the probability of water pump abrasion and clogging during initial production of water from the well.

It will be appreciated that the apparatus of the invention may also be used, following completion of the air jetting operation and prior to removal of the string of drill pipe with interconnected portions 30 and 50 from the well bore, to determine both the flow rate of the well and the static height of water in the well casing above the well seal. To determine the height of a column of water in the well casing, the apparatus is raised in the well bore a measured distance above the position of well seal 12 and above the anticipated top of the column of water. After elapse of sufficient time for the water in the well bore to reach a static level, pressurized air is again introduced into the top of the string of drill pipe and the string is lowered slowly in the well bore until the flow of pressurized air up the well casing begins to entrain water, when another measurement is taken. The height of the column of water may then be readily calculated from the measured distances and the known dimensions of the components of the apparatus.

The flow rate of the well may be determined by first lowering the string of drill pipe and interconnected portions 30 and 50 of the apparatus to a point at or near the location of well seal 12, and introducing pressurized air into the string of drill pipe to force water above the upper edge of wall 55 of air distributor 52 from the well. The string of drill pipe and interconnected portions 30 and 50 of the apparatus are then raised a measured distance up the well casing which will leave the upper edge of side wall 55 below the top of a static column of water in the casing, while introduction of pressurized air is continued. The elapsed time for water to flow into the well casing and reach a level where water is again entrained in the flow of air from the well casing is measured, and the flow rate may then be calculated from the height and time measurements in combination with the known quantities of incremental casing volume. It will be appreciated by those skilled in the art that determination of water flow rate greatly facilitates selection of a pump with the appropriate capacity to produce the well at the highest rate which can be achieved without pumping the well dry.

When the desired operations down the well bore are completed, the string of drill pipe with interconnected portions 30 and 50 of the apparatus of the invention is removed from the well, which is ready for placement of a production pump. Portions 30 and 50 of the apparatus are disconnected from the drill pipe and retained for subsequent use.

The foregoing disclosure and description of the apparatus and methods of the invention are explanatory only, and changes in the details of construction of the apparatus and of practice of the method may be made by those skilled in the art without departing from the scope and spirit of the invention.

What is claimed is:

1. An apparatus for setting a well screen, placing a well seal, and placing packing material in a partially cased water well bore having a well casing extending continuously from the top of the well bore toward the bottom of the well bore and ending short of the bottom of the well bore to divide the well bore into an upper cased portion and a lower uncased portion, comprising:

a first elongate cylindrical housing, having a hollow interior, open first and second ends and a central longitudinal axis, for positioning a well screen below the casing in the uncased portion of the well bore and positioning the well seal above the lower end of the casing in the cased portion of the well bore, forming a passageway for the flow of water from the interior of said well screen upward through the interior of said first elongate cylindrical housing to the cased portion of the well bore above said well seal, said first elongate cylindrical housing including a plurality of first apertures disposed in and penetrating said first elongate cylindrical housing to form a passage for conducting packing sand from the interior of said first elongate cylindrical housing to the uncased portion of the well bore on the exterior of said well screen and below said well seal;

a second elongate cylindrical housing with a hollow interior, open first and second ends and a central longitudinal axis, having an elongate hollow cylindrical insert with first and second ends concentrically disposed in the interior of said second elongate cylindrical housing and interconnected at the second, upper, end of said elongate hollow cylindrical insert to the second, upper, end of said elongate cylindrical housing;

a plurality of second apertures penetrating said elongate hollow cylindrical insert for conducting packing sand from the interior of said elongate hollow cylindrical insert through said first apertures in said first elongate cylindrical housing to the uncased portion of the well bore on the exterior of said well screen and below said well seal;

an open-ended hollow cylindrical sleeve with first and second ends slideably disposed in the interior of said first elongate cylindrical housing and first bias means to bias said open-ended hollow cylindrical sleeve toward a rest position near the second, upper end of said first elongage cylindrical housing for closing said first apertures in said first elongate cylindrical housing;

an open-ended hollow cylindrical collar with first and second ends, slideably disposed on the exterior of said elongate hollow cylindrical insert and second bias means to bias said open-ended hollow cylindrical collar toward a rest position near the first, lower, end of said elongate hollow cylindrical insert;

a first attachment means for attaching a well screen to the first, lower, end of said first elongate cylindrical housing, and a second attachment means for attaching the second, upper, end of said second elongate cylindrical housing to a string of drill pipe; and an open-ended hollow cylindrical coupler ring for releaseably interconnecting the second, upper, end of said first elongate cylindrical housing to the first, lower, end of said second elongate cylindrical housing.

2. The apparatus of claim 1, wherein the outside cross-sectional diameter of said first elongate cylindrical housing is equal to the outside cross-sectional diameter of said second elongate cylindrical housing;

said elongate hollow cylindrical insert is of substantially greater length than said second elongate cylindrical housing, such that the first end of said elongate hollow cylindrical insert extends beyond the first end of said second elongate cylindrical housing and the first end of said elongate hollow cylindrical insert is closed;

the outside cross-sectional diameter of said elongate hollow cylindrical insert is equal to the outside cross-sectional diameter of said open-ended hollow cylindrical sleeve;

the inside cross-sectional diameter of said open-ended hollow cylindrical collar is equal to the inside cross-sectional diameter of said first elongate cylindrical housing;

the outside cross-sectional diameter of said elongate hollow cylindrical insert is sufficiently smaller than the inside cross-sectional diameter of said second elongate cylindrical housing to define an annular space between the outside surface of said elongate hollow cylindrical insert and the inside surface of said second elongate cylindrical housing which will receive said open-ended hollow cylindrical collar therein upon sliding of said open-ended hollow cylindrical collar along said elongate hollow cylindrical insert;

said first apertures are disposed near said second, upper end of said first elongate cylindrical housing are are obstructed by said open-ended hollow cylindrical sleeve in its rest position;

said second apertures are disposed near said first, lower end of said elongate hollow cylindrical insert and are obstructed by said open-ended hollow cylindrical collar in its rest position; and the lengths of said first elongate cylindrical housing, said second elongate cylindrical housing, and said elongate hollow cylindrical insert, and the position of said first apertures and said second apertures in said first elongate cylindrical housing and said elongate hollow cylindrical insert, respectively, are such that said apertures are brought into coaxial alignment upon insertion of the first, lower, end of said elongate hollow cylindrical insert into the interior of said first elongate cylindrical housing through the second, upper, end thereof and coupling of the second, upper, end of said first elongate cylindrical housing to the first, lower, end of said second elongate cylindrical housing by means of said open-ended hollow cylindrical coupler ring.

3. The apparatus of Claim 1, wherein said first bias means comprises a first coil spring of substantially the same cross-sectional diameter as said open-ended hollow cylindrical sleeve, disposed in the interior of said first elongate cylindrical housing between the first, lower, end of said sleeve and said first, lower, end of said first elongate cylindrical housing, and retained in the interior of said first elongate cylindrical housing by spring retaining means.

4. The apparatus of claim 3, wherein said spring retaining means comprises an annular ring disposed in a continuous groove in the inner surface of the wall of said first elongate cylindrical housing near the first, lower, end thereof, lying in a plane perpendicular to the central longitudinal axis of said first elongate cylindrical housing, with said annular ring extending into the interior of said first elongate cylindrical housing a sufficient distance to contact and retain the end of said spring nearest said first, lower, end of said first elongate cylindrical housing.

5. The apparatus of claim 1, wherein said second bias means comprises a second coil spring of substantially the same cross-sectional diameter as said open-ended hollow cylindrical collar, concentrically disposed about the exterior of said elongate hollow cylindrical insert, extending from said open-ended hollow cylindrical collar through the annular space between the exterior surface of said elongate hollow cylindrical insert and the interior surface of said second elongate cylindrical housing, and retained by the interconnection between said elongate hollow cylindrical insert and said second elongate cylindrical housing.

6. Apparatus for setting a well screen, placing a well seal, placing packing material around the well screen below the well seal in a partially cased water well bore, having a casing extending continuously from the top of the well bore toward the bottom of the well bore and ending short of the bottom of the well bore, dividing the well bore into an upper cased portion and a lower uncased portion, and cleaning of contaminated water from the well bore above the well seal, in a single trip into the well, comprising a well seal and well screen retainer portion including a first elongate cylindrical housing having a hollow interior, first and second open ends, and a central longitudinal axis, defining a passageway on the interior thereof for flow of water entering the interior of said screen upward through the interior of said first elongate cylindrical housing; means of attaching a well screen to the first, lower, end of said first elongate cylindrical housing; a short open-ended hollow cylindrical first coupler ring concentrically disposed around the second, upper, end of said first elongate cylindrical housing with said second, upper, end of said first elongate cylindrical housing extending partially through the interior of said coupler ring, and with a well seal concentrically disposed around the outer surface of said coupler ring and firmly interconnected thereto; a plurality of first apertures penetrating said first elongate cylindrical housing near its second, upper, end; an open-ended hollow cylindrical sleeve slideably disposed in the interior of said first elongate cylindrical housing and biased toward a rest position in the interior of said first elongate cylindrical housing in obstruction of said first apertures by first bias means disposed in the interior of said first elongate cylindrical housing between said open-ended hollow cylindrical sleeve and said first, lower, end of said elongate cylindrical housing;

a packing sand distributor portion including a second elongate cylindrical housing having a hollow interior, first and second open ends, and a central longitudinal axis; means of attaching the first, lower, end of said second elongate cylindrical housing to said first coupler ring; means of attaching the second, upper, end of said second elongate cylindrical housing to a second coupler ring; an elongate hollow insert having a first, closed, end and a second, open, end, concentrically disposed in the interior of said second elongate cylindrical housing and interconnected at its second end to the second end of said second elongate cylindrical housing so as to define an annular space between the outer surface of said elongate hollow insert and the inner surface of said second elongate cylindrical housing. the first, lower, end of said elongate hollow insert extending beyond the first, lower, end of said second elongate cylindrical housing; a plurality of second apertures penetrating said elongate hollow insert near its first end; an open-ended, hollow cylindrical collar slideably disposed around said elongate hollow insert and biased toward a rest position on the exterior of said elongate hollow insert in obstruction of said second apertures by second bias means disposed around the exterior of said elongte hollow insert between said open-ended, hollow cylindrical collar and said second end of said elongate hollow insert;

an air jet portion a third elongate cylindrical housing having a hollow interior, first and second open ends, and a central longitudinal axis; means of attaching the second, upper, end of said third elongate cylindrical housing to a string of hollow drill pipe; a plurality of third apertures penetrating said third elongate cylindrical housing near its first, lower, end; a short open-ended hollow cylindrical second coupler ring concentrically disposed around said first end of said third elongate cylindrical housing and interconnected thereto at its second end such that a first end of said second coupler ring extends beyond said first end of said third elongate cylindrical housing; a plurality of third apertures penetrating said third elongate cylindrical housing near its first end; an open-ended hollow cylindrical air distributor disposed around said third elongate cylindrical housing intermediate its two ends overlying said third apertures and interconnected to said first end of said third elongate cylindrical housing and to a second end of said second coupler ring, defining an annular space between the inner surface of said air distributor and the outer surface of said third elongate cylindrical housing.

7. The apparatus of claim 6, wherein the outside cross-sectional diameters of said first elongate cylindrical housing, said second elongate cylindrical housing and said third elongate cylindrical housing are the same;

the outside cross-sectional diameters of said open-ended hollow cylindrical sleeve and of said elongate hollow insert are the same;

the outside cross-sectional diameter of said air distributor is slightly less than the inside cross-sectional diameter of the well casing so as to allow said air distributor to travel longitudinally relative to said casing without binding therein;

the inside cross-sectional diameters of said first elongate cylindrical housing and of said open-ended hollow cylindrical collar are the same; and the length of said second elongate cylindrical housing, the length of said elongate hollow insert, the longitudinal position of said second apertures in said elongate hollow insert, and the longitudinal position of said first apertures in said first elongate cylindrical housing are such that upon coaxial interconnection of the well seal and well screen retaining portion with the packing sand distributor portion by insertion of said elongate hollow insert into the interior of said first elongate cylindrical housing and attachment between said first coupler ring and the first end of said second elongate cylindrical housing, said first and second apertures are brought into coaxial alignment to define a flow path for packing sand from the interior of said elongate hollow insert to the exterior of said first elongate cylindrical housing below said well seal.

8. The apparatus of claim 7, wherein said means of attaching a well screen to said first end of said first elongate cylindrical housing comprises right-handed male screw threads disposed on the exterior of said first end of said first elongate cylindrical housing.

9. The apparatus of claim 7, wherein said means of attaching said second end of said second elongate cylindrical housing to a second coupler ring comprises right-handed male screw threads disposed on the exterior of said second end of said second elongate cylindrical housing, mating with right-handed female screw threads disposed on the interior of said second coupler ring.

10. The apparatus of claim 7, wherein said means of attaching said second end of said third elongate cylindrical housing to a string of hollow drill pipe comprises right-handed male screw threads disposed on the exterior of said second end of said third elongate cylindrical housing.

11. The apparatus of claim 7, wherein said means of attaching the first end of said second elongate cylindrical housing to said first coupler ring comprises left-handed male screw threads disposed on the exterior of said first end of said second elongate cylindrical housing, mating with left-handed female screw threads disposed on the interior of said first coupler ring.

12. The apparatus of claim 7, wherein said first bias means comprises a coil spring with an outside cross-sectional diameter generally equal to the outside cross-sectional diameter of said open-ended hollow cylindrical sleeve, disposed on the interior of said first elongate cylindrical housing between said open-ended hollow cylindrical sleeve and said first end of said first elongate cylindrical housing and retained therein by an annular spring retainer ring disposed in a groove near said first end of said first elongate cylindrical housing and extending into the interior of said first elongate cylindrical housing in a plane perpendicular to the longitudinal axis of said first elongate cylindrical housing.

13. The apparatus of claim 7, wherein said second bias means comprises a coil spring with an inside cross-sectional diameter generally equal to the inside cross-sectional diameter of said open-ended hollow cylindrical collar, disposed on the exterior of said elongate hollow insert and extending into the annular space between said elongate hollow insert and said second elongate cylindrical housing and retained by the interconnection between said elongate hollow insert and said second elongate cylindrical housing.

14. The apparatus of Claim 7, wherein said open-ended hollow cylindrical sleeve is retained in its rest position against said bias by abutment of said open-ended hollow cylindrical sleeve against sleeve retainer means disposed on the inner surface of said first elongate cylindrical housing; and said open-ended hollow cylindrical collar is retained in its rest position agains said bias by abutment of said open-ended hollow cylindrical collar against collar retainer means disposed on the outer surface of said elongate hollow insert.

15. In the completion of a water well having a well casing extending continuously from the top of the well bore toward the bottom of the well bore, following the steps of setting a well screen near the bottom of the well bore, setting a well seal within the well casing above the well screen but below the top of a static column of water which will be produced by the well, and placing packing sand on the exterior of the well screen below the well seal with a completion apparatus which includes an air jet portion, attached to the bottom of a string of hollow drill pipe, which air jet portion forms a flow path for air from the interior thereof to the annular space between the exterior thereof and the well casing, a method of determining the height of the static column of water produced by the well into the well casing above the well seal prior to withdrawing the string of drill pipe and attached air jet portion of the completion apparatus from the well bore comprising the steps of allowing a sufficient period of time for the water flowing into the casing to reach a static level;

raising the string of drill pipe and attached air jet portion of the completion apparatus a measured distance from the position of the well seal in the casing to a position above the top of the column of water in the casing;

introducing pressurized air into the top of the string of drill pipe and forcing air to flow down the drill pipe the the air jet portion of the completion apparatus, through the flow path to the annular space in the casing, and up the annular space to the top of the well, and lowering the string of drill pipe and attached air jet portion of the completion apparatus slowly in the well bore until water is entrained in the flow of air to the top of the well; and measuring the distance traveled back down the well bore to the point of water entrainment at the top of the column of water, and calculating the height of such column above the well seal from the measured distances and known dimensions of the components of the completion apparatus.

16. In the completion of a water well having a well casing extending continuously from the top of the well bore toward the bottom of the well bore, following the steps of setting a well screen near the bottom of the well bore, setting a well seal within the well casing above the well screen but below the top of a static column of water which will be produced by the well, and placing packing sand on the exterior of the well screen below the well seal with a completion apparatus which includes an air jet portion, attached to the bottom of a string of hollow drill pipe, which air jet portion forms a flow path for air from the interior thereof to the annular space between the exterior thereof and the well casing, a method of determining the flow rate of the well prior to withdrawing the string of drill pipe and attached air jet portion of the completion apparatus from the well bore comprising the steps of lowering the string of drill pipe and attached portions of the completion apparatus until the bottom of the completion apparatus is at the level of the well seal;

removing water from the well bore above the air jet portion of the completion apparatus by forcing pressurized air down the interior of the string of hollow drill pipe, to the interior of the air jet portion of the completion apparatus, through the flow path to the well bore on the exterior of the air jet portion of the completion apparatus, and up the well bore through the annular space between the well bore and the exterior of the air jet portion of the completion apparatus and of the string of drill pipe, to entrain such water in the air stream and force such water upward through such annular space and out the top of the well bore;

raising the string of drill pipe and attached air jet portion of the completion apparatus a sufficient measured distance up the well casing to raise the air flow pathe above the present level of water in the well but below the top of the static column of water which will be produced by the well, while continuing the flow of air; and measuring the elasped time until water is again entrained in the flow of air from the top of the well bore, and calculating the flow rate of the well from the measurement of elapsed time, the known cross-sectional area of the well casing, and the know volume of the components of the completion apparatus.

* * * * *